United States Patent [19]

Long et al.

[11] 4,139,114

[45] Feb. 13, 1979

[54] COMPOSITE CONTAINER HAVING A PLURALITY OF REMOVABLE SECTIONS

[76] Inventors: Elizabeth T. Long; Leonard L. Long, both of 3573 Knollwood Dr., NW., Atlanta, Ga. 30305

[21] Appl. No.: 780,256

[22] Filed: Mar. 23, 1977

[51] Int. Cl.[2] ..... B65D 21/02

[52] U.S. Cl. ..... 220/23.4; 206/436; 206/821; 215/10; 220/4 D; 229/22

[58] Field of Search ..... 220/4D, 23.2, 23.4, 220/270; 215/10; 229/22; 206/436, 821, 427, 428, 504

[56] References Cited

U.S. PATENT DOCUMENTS

| | | | |
|---|---|---|---|
| 666,090 | 1/1901 | Dryfoods | 215/10 |
| 1,236,977 | 8/1917 | Pike | 206/436 |
| 1,571,049 | 1/1926 | Gatchell | 220/23.2 |
| 1,939,719 | 12/1933 | Nicholls | 220/20 |
| 2,111,884 | 3/1938 | Cahaney | 220/352 |
| 2,483,464 | 10/1949 | Johnson | 229/22 |
| 2,677,460 | 5/1954 | Johnston | 206/162 |
| 2,679,281 | 5/1954 | Paulucci | 220/430 |
| 3,348,727 | 10/1967 | Jasper | 220/270 |
| 3,389,830 | 6/1968 | Smith | 220/23.4 |

FOREIGN PATENT DOCUMENTS

| | | | |
|---|---|---|---|
| 865037 | 4/1961 | United Kingdom | 229/22 |

*Primary Examiner*—George E. Lowrance
*Attorney, Agent, or Firm*—Newton, Hopkins & Ormsby

[57] ABSTRACT

Separable container compartments for liquids and solids are separably joined to form a composite unit of a plurality of independently closed container compartments. After the selective separation of one of the compartments from the composite, it may be opened by use of the opening means that is associated therewith.

6 Claims, 9 Drawing Figures

COMPOSITE CONTAINER HAVING A PLURALITY OF REMOVABLE SECTIONS

BACKGROUND OF THE INVENTION

Multi-compartment containers including containers with separable compartments are known in the prior art. Some pertinent examples of the patented prior art are U.S. Pat. Nos. 2,605,013; 2,695,238; 3,081,926; 3,139,229 and 3,547,303.

The objective of the present invention is to improve on the known prior art pertaining to multi-compartment containers by rendering the same more practical and more convenient as containers for liquids and solids, and also by making them more economical to manufacture. Typically, the invention in several embodiments provides compartmented containers for liquids and solids and the like wherein individual compartments are easily separated from the remaining compartments which remain joined in the composite container. Each compartment or segment of the container has its own convenient opening means which may be in the form of a pull tab of the kind employed on cans at the present time.

The separable compartments may contain either liquids or solids or a combination thereof so that the composite unit may be made up of compartments that contain different contents, which may be food products such as beverages or solid foods or industrial or household products such as oil, paint, detergents, and the like.

The compartments may be made of metal, plastic, paperboard and other commercially available materials that are adapted for container fabrication or materials that may later become available.

One important advantage of this container is that when one compartment is removed and used it may be then discarded thus affording more storage room in the area where the remaining compartments are kept. When a separate compartment is removed from the composite container and is not used, the remainder of the container can also be more readily stored.

In one embodiment, the operation of the opening means on one compartment in a sidewise manner rather than a lifting manner, initiates the separation of that compartment from the remaining compartments of the composite unit prior to the selective opening thereof.

The advantage of the invention in terms of simplicity, economy and convenience over the prior art will be readily appreciated by those skilled in the art in light of the following detailed description.

DETAILED DESCRIPTION

Figure 1:
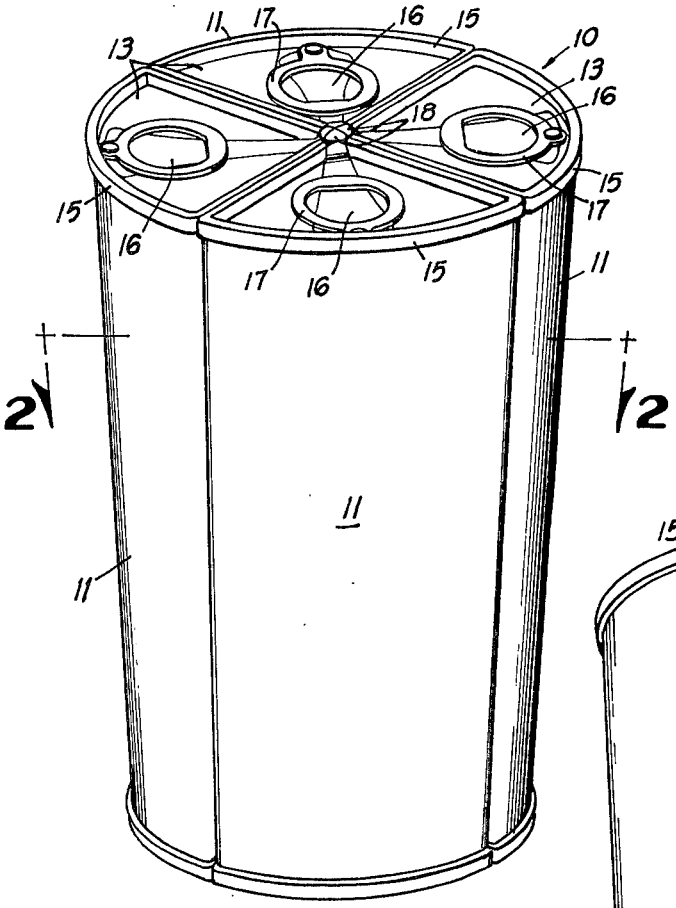
FIG. 1 is a perspective view of a compartmented container with separable compartments according to a preferred embodiment of the invention.
Figure 2:
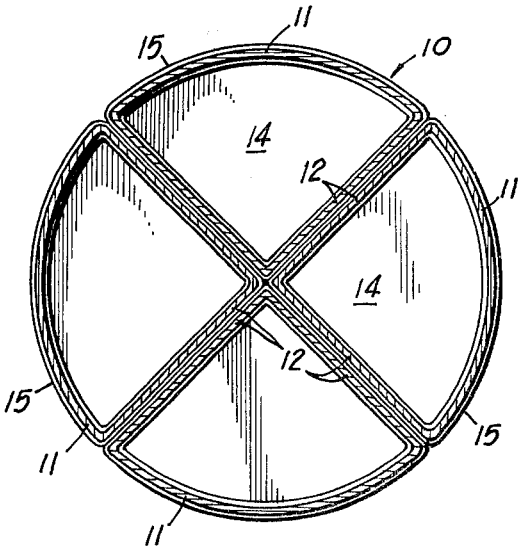
FIG. 2 is a horizontal section taken on line 2—2 of FIG. 1.
Figure 3:
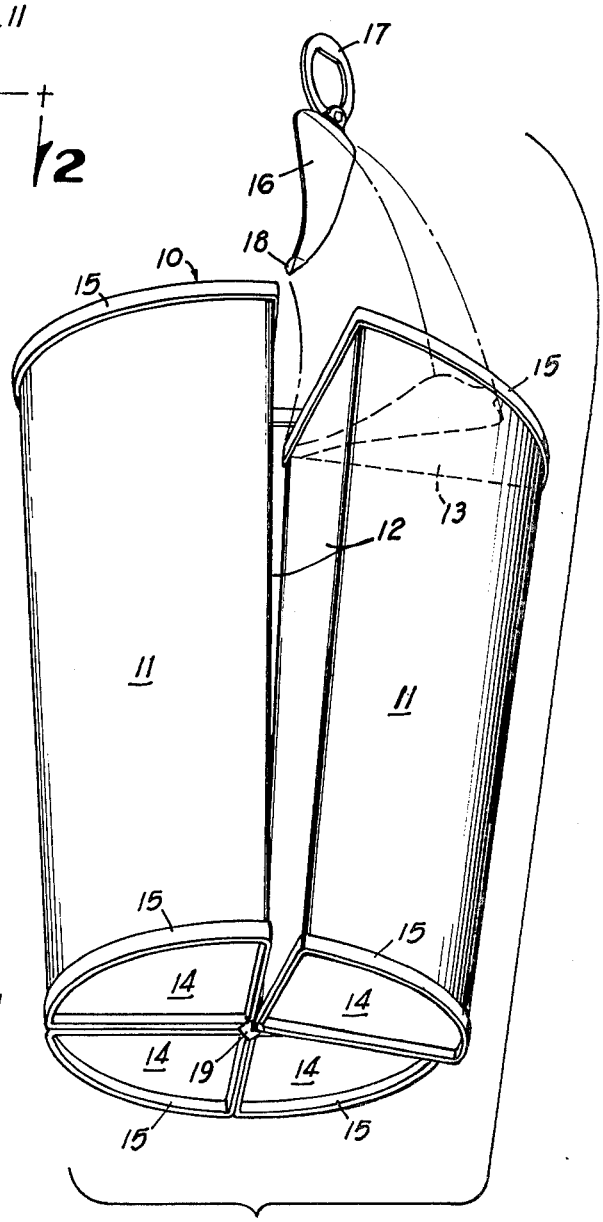
FIG. 3 is a partly exploded perspective view of the invention according to FIG. 1.

Referring to the drawings in detail wherein like numerals designate like parts, attention is directed first to FIGS. 1–3 showing one preferred embodiment. In these figures, a composite cylindrical beverage container 10 typically formed of aluminum comprises preferably four equally sized wedge-like compartments or cells 11 arranged in a circumferential array with the flat radial walls 12 of adjacent compartments substantially in abutting relationship, FIG. 2.

Each compartment 11 of the composite container unit 10 is a completely closed independent container of the size desired. Each compartment 11 has opposite end walls 13 and 14 and these end walls have marginal continuous flanges 15 which embrace the radial and circumferential side walls of the compartment 11 and are joined thereto to form a liquid tight seal in a known manner. It will be understood that the several compartments 11 are separate and independent in terms of their usage but are initially joined in the unitized cylindrical container 10.

Each compartment end wall 13 is equipped with an opening means such as a pull tab closure 16 of the general type commonly employed on cylindrical cans and including a manual pull ring 17. Each tab 16 is tapered toward the center of the composite cylindrical container 10 and its inner tip is joined by a wedge-like solder segment 18, FIG. 3, with like solder segments on the other pull tabs 16 of the composite container. As shown in FIG. 1, the four solder segments 18 are integrally joined at one end of the container to initially secure the several wedge-like compartments 11 in fixed assembled relationship prior to usage. A similar solder globule 19 is provided at the opposite end of the container 10 to join the flanges 15 of the several compartments 11 at the axial center of the composite container 10.

In order to use the compartmented container, the flange 15 of one compartment 11 is grasped and pulled in a sidewise manner from composite container 10 and in so doing the solder segment 18 at this upper end of the container is separated cleanly from the remainder of the solder globule at this end which may be scored for ease of separation, as shown in FIG. 1. Once the first compartment 11 is separated from the composite container 10 it is an easy manipulation to separate its opposite end from the solder globule 19 by a slight rocking movement of the chosen compartment 11. The chosen compartment 11 may then be opened by lifting pull tap 16.

The remaining compartments 11 are still securely joined by the end solder globules and remain sealed and their integrity for storage and/or refrigeration is not impaired by the removal of the one compartment, as described. The other compartments 11 of the composite container 10 can be separated and then opened in the described manner when needed. The arrangement is simple and highly convenient and economical in terms of materials and available closure means.

Figure 4:
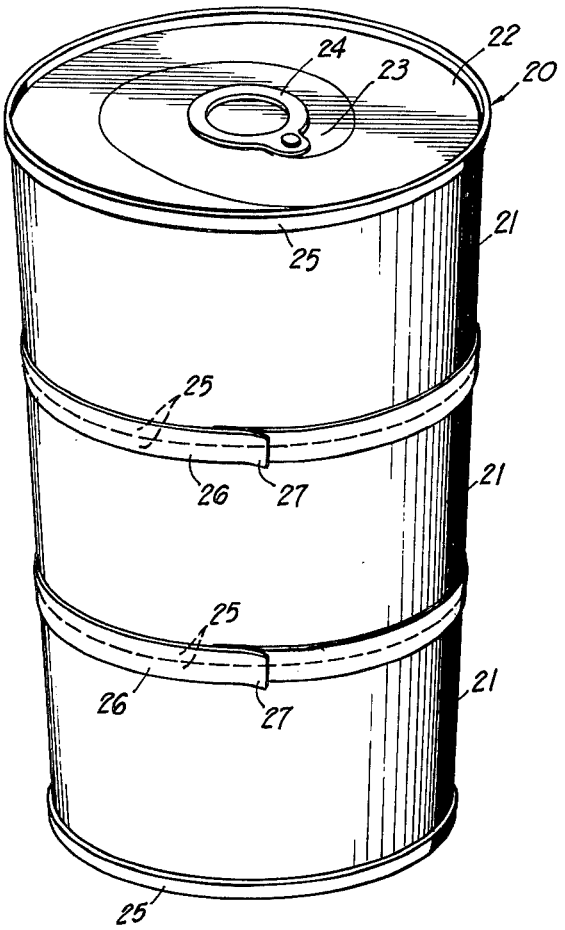
FIG. 4 is a perspective view of another embodiment of the invention.

FIG. 4 shows another embodiment of the invention in which a unitized cylindrical container 20 includes a plurality such as three, separable self-contained and individually sealed compartments or sections 21. The corresponding end wall 22 of each compartment 21 has a spiral pull tab closure 23 thereon equipped with a manual pull ring 24. The compartment end walls have marginal flanges 25 which embrace the cylindrical side walls of the compartments and are conventionally sealed thereto. The uppermost and intermediate compartments 21 have additional marginal skirts 26 outwardly of the flanges 25 and adapted to circumferentially adhere the two abutting flanges 25 adhesively when the three compartments 21 are placed together in an assembled stack. The sealed engagement through the skirts 26 can be separated manually by pulling strip tab 27 to strip skirt 26 and allow separation and independent use of the compartments 21 individually.

Figure 5:
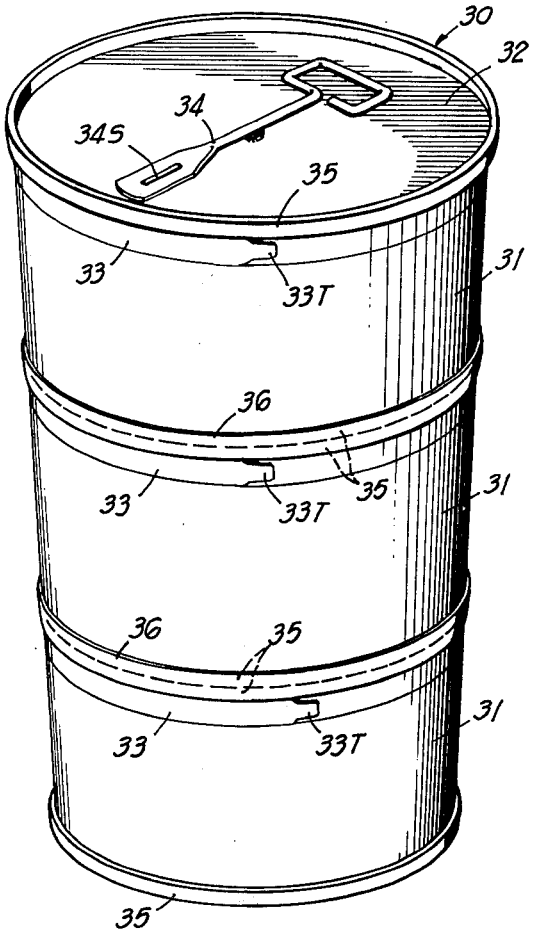
FIG. 5 is a perspective view of another embodiment of the invention.
Figure 6:
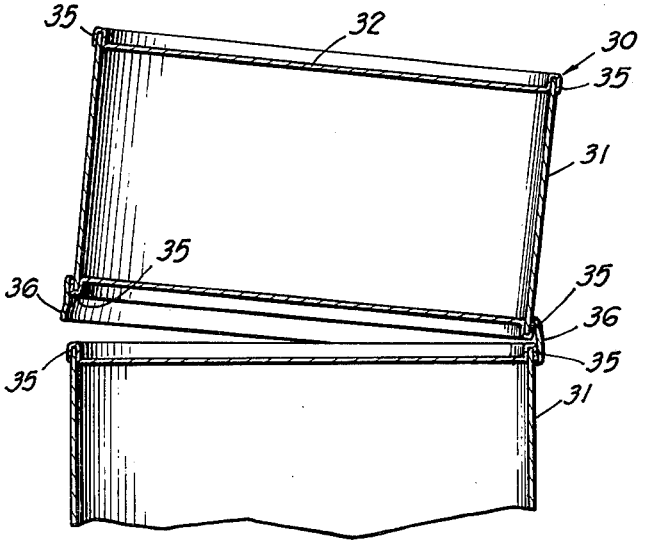
FIG. 6 is a fragmentary vertical cross-sectional view of the invention in FIG. 5 with adjacent container compartments partly separated.

FIGS. 5 & 6 show a composite compartmented container 30 somewhat similar to the container 20 in FIG. 4 wherein the container 30 includes stacked independent compartments 31. The corresponding end wall 32 of each compartment 31 has a zipper key 34 spot soldered thereon. These compartment end walls have marginal flanges 35 which embrace the cylindrical side walls of the container compartments 31 and are conventionally sealed thereto. Abutting upper flange 35 and circumferentially encompassing an upper portion of each compartment 31 is a zipper strip 33 with a starting tab 33T. To open a selected compartment the key 34 is removed and positioned so that starting tab 34T is in slot 34S in the key 34 and the key is turned in a conventional zipper opening manner. The uppermost and intermediate compartments 31 have an additional lower marginal skirt 36 outwardly of flanges 35 and adapted to telescope thereover tightly and frictionally engage an abutting pair of flanges 35 in an assembled stack. The telescoped and frictional engagement through the skirts 36 can be separated manually as depicted in FIG. 6 to allow separation and independent use of the compartments 31 individually.

Figure 7:
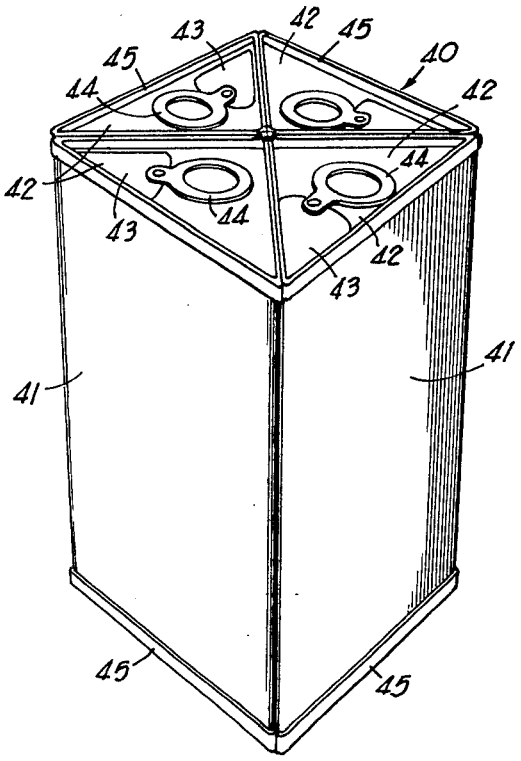
FIG. 7 is a perspective view of another embodiment.

FIG. 7 shows another embodiment of modified construction similar to the composite container 10 of FIG. 1, wherein the composite compartmented container 40 is rectangular and subdivided into right triangular guadrante compartment 41, each hypothenuse side of the four triangles forming an outside of the composite container 40. Each compartment 41 has an end wall 42 the upper wall of which is adapted with a pull tab opening 43 having a pull ring 44 thereon. Upper and lower end walls 42 have marginal flanges 45 which embrace the side walls of each compartment 41 and thereby seal the ends and sidewalls.

Each compartment is joined at its innermost tip on flanges 15 by a globule of solder 46 having score lines that correspond to that portion of the intersection they overlap. A similar solder globule is provided at the opposite end of the container 40 to pin flanges 15 of the several compartments at the axial center of the composite container 40.

The separation and use of the composite container 40 is similar to that container 10 in FIG. 1. A sidewise exertion of pressure to the outside flange 45 to separate the globule 46 at the score line, and folding down of the compartment will break the bottom solder globule thereby separating a compartment for use whenever desired.

Figure 8:
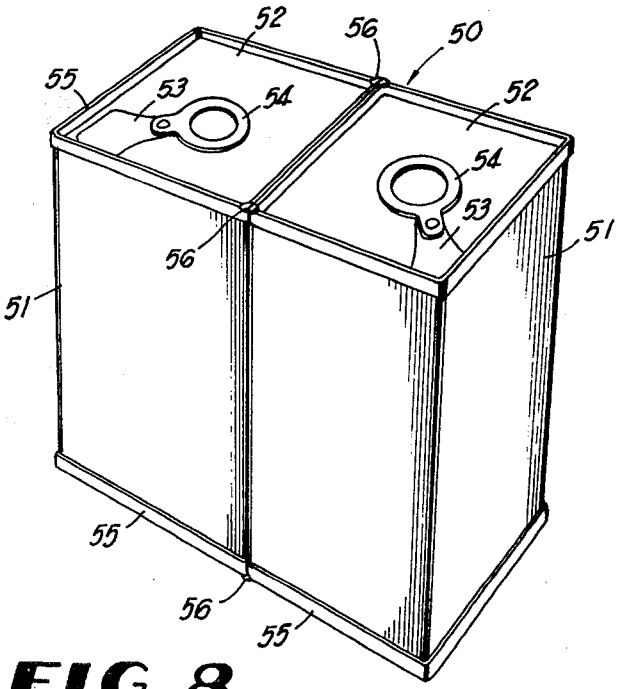
FIG. 8 is a perspective view of another embodiment.

FIG. 8 is a further embodiment similar in scope to FIG. 7 wherein a pair of rectangular compartments 51 form the composite compartmented container 50. Each compartment 51 having an upper and lower end wall 52 terminating in marginal flanges 55 which are conventionally sealed to the side walls of each compartment 51. The upper end wall 52 of each compartment 51 is detailed with a pull tab closure 53 having a pull tab ring 54.

Juxtaposed corresponding flat sides of each compartment 51 are abutted to each other so as to align the compartments in a side-by-side relationship with their flanges 55 in abuttment. At each corner of the abutting flanges is a globule of solder 56 which is scored to releasably separate upon an exertion of motion to each compartment outward from their union at the solder joints.

Figure 9:
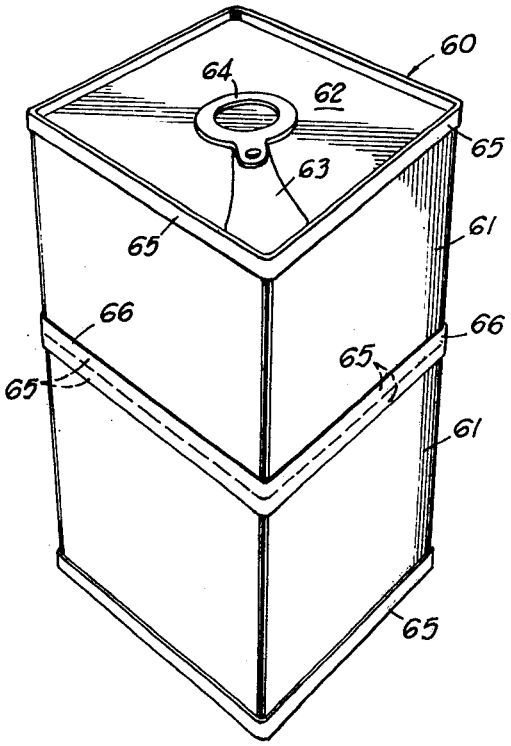
FIG. 9 is a perspective view of still another embodiment of the invention.

FIG. 9 is a final embodiment which shows a composite compartmented container 60 which is similar in scope to container 30, FIG. 5, wherein the can 60 is modified to be rectangular in shape with stacked compartments 61 having end walls 62, the upper walls of which are detailed with pull tab closures 63 which conventionally bonds ends 62 to each side wall of each individual compartment 61. Between the upper and lower compartments 61 and surrounding the abutting flanges 65 thereof is an outer skirt member 66 which telescopically receives and frictionally engages the flanges 65, thereby forming the composite compartmented container 60.

It is to be understood that the forms of the invention herewith shown and described are to be taken as preferred examples of the same, and that various changes in the shape, size and arrangement of parts may be resorted to, without departing from the spirit of the invention or scope of the subjoined claims.

What is claimed is:

1. In a compartmented container for liquids and solids including a plurality of independent closed container sections, means separably joining said container sections in assembled relationship to form a unitized multi-compartment container and opening means on each container section allowing it to be opened independently of the other container sections, the unitized multi-compartment container being cylindrical and the container sections being wedge-like with each container section having a pair of flat converging radial walls and a circumferential wall, the improvement of the opening means of the container sections being on corresponding ends thereof and being radially disposed with the inner ends of the opening means extending near the axial center of the multi-compartment container, and separable means joining the inner ends of the opening means and thereby separably joining the container sections for selective removal of an independent closure container section, said separable means comprising a globule having separable joined wedge-like portions attached to said inner ends of the opening means whereby a selected independent section may be removed from the unitized multi-compartment container by pulling the section sidewise and separating it from the remaining portion of the separable globule.

2. A compartmented container for liquids and solids as defined in claim 1, and another separable globule at the opposite end and axial center of said multi-compartment container separately joining the container sections adjacent said opposite end that may be separated by a rocking movement of a section that has been separated from the separable means that joins the plurality of opening means.

3. A compartmented container for liquids and solids as defined in claim 1, and said opening means being pull tab closure elements that are wedge-shaped and tapering toward the axial center of the multi-compartment container and being circumferentially centered on each container section, and said separable means comprising a frangible globule at the axial center of the multi-compartment container joined to the inner ends of all of the pull tab closure elements.

4. A compartmented container for liquids and solids as defined in claim 3, and said frangible globule being scored radially to form therein separable sections of the globule with one section joined to each pull tab closure element.

5. In a compartmented container for liquids and solids including at least three independent closed container sections, means separately joining said container sections in assembled relationship to form a unitized multi-compartment container and opening means on each container section allowing it to be opened independently of the other container sections, the improvement of each container section having a pair of flat, converging radial walls extending to near the axial center of the multi-compartment container and separable means comprising a globule having separable joined wedge-like portions, demarcated by score lines, each such wedge-like portion being attached to the inner end of one of said container sections, whereby a selected container section may be removed from the unitized multi-compartment container by pulling the section sidewise and separating it from the remaining portion of the globule.

6. A compartmented container for liquids and solids as defined in claim 5, and another separable means at the opposite end and axial center of said multi-compartment container separately joining the container sections adjacent said opposite end that may be separated by a rocking movement of a section that has been separated from the separable means that joins the plurality of opening means.

* * * * *